US007371979B2

(12) United States Patent
Fuzetti et al.

(10) Patent No.: US 7,371,979 B2
(45) Date of Patent: May 13, 2008

(54) ELECTRICAL INTERCONNECTION ARRANGEMENT

(75) Inventors: Vagner Fuzetti, Bragança Paulista (BR); Jose Alexandre La Salvia, São José dos Campos (BR)

(73) Assignee: Tyco Electronics Brasil Ltda., Sao Paulo (BR)

( * ) Notice: Subject to any disclaimer, the term of this patent is extended or adjusted under 35 U.S.C. 154(b) by 0 days.

(21) Appl. No.: 10/578,799

(22) PCT Filed: Aug. 1, 2003

(86) PCT No.: PCT/RU03/00343
§ 371 (c)(1),
(2), (4) Date: Oct. 18, 2006

(87) PCT Pub. No.: WO2005/053104

PCT Pub. Date: Jun. 9, 2005

(65) Prior Publication Data

US 2007/0097586 A1 May 3, 2007

(30) Foreign Application Priority Data

Nov. 5, 2003 (GB) ..... 0325868.8

(51) Int. Cl.
*H01H 3/00* (2006.01)

(52) U.S. Cl. ..... 200/17 R; 439/709

(58) Field of Classification Search ..... 200/1 R, 200/5 R, 17 R, 18, 50.01–50.04, 293; 439/709, 439/710, 711–715, 723, 724; 361/632, 669–671
See application file for complete search history.

(56) References Cited

U.S. PATENT DOCUMENTS

| | | | | |
|---|---|---|---|---|
| 2,669,611 | A * | 2/1954 | Silvius | 200/4 |
| 3,858,012 | A * | 12/1974 | Lockard | 200/16 D |
| 5,030,139 | A * | 7/1991 | Huska | 439/513 |
| 5,383,090 | A * | 1/1995 | Freundner et al. | 361/624 |
| 5,990,424 | A * | 11/1999 | Miyazaki | 200/16 R |
| 6,576,851 | B1 * | 6/2003 | Barlian et al. | 200/5 R |
| 6,630,637 | B1 * | 10/2003 | Ward et al. | 200/17 R |
| 2002/0122279 | A1 * | 9/2002 | Greenberg et al. | 361/42 |

FOREIGN PATENT DOCUMENTS

| | | |
|---|---|---|
| DE | 1115804 | 10/1961 |
| DE | 199 02 931 A1 | 7/2000 |
| GB | 272 617 | 6/1927 |
| GB | 721 684 | 1/1955 |
| GB | 848 546 | 9/1960 |
| GB | 1 035 346 | 7/1966 |
| GB | 1 554 645 | 10/1979 |
| GB | 2 357 639 A | 6/2001 |
| WO | WO91/14298 | 9/1991 |

* cited by examiner

*Primary Examiner*—Elvin Enad
*Assistant Examiner*—M. Fishman

(57) ABSTRACT

An electrical busbar arrangement has provision for connecting a single feeder cable to a plurality of branch cables within an insulating housing. A branch port is provided for each branch cable, and a spring-loaded slidable support plate is arranged to receive the branch cable and to retain it in an aperture thereof. The support plate moves within a cable holder that is driven by a rotatable cam by means of a switch. Operation of the switch between OFF and ON positions is effective to move the branch cable into and out off contact respectively with the busbar. The switches of each port are selectively operable independently of each other. In this way, branch cables may be independently and selectively mounted in the housing and brought into electrical connection with and disconnected from the busbar.

7 Claims, 8 Drawing Sheets

ELECTRICAL INTERCONNECTION ARRANGEMENT

BACKGROUND OF THE INVENTION

This invention relates to an electrical interconnection arrangement, which finds particular, though not exclusive, application in providing connection to a busbar having a current capacity greater than 30 A, preferably greater than 50 A, more preferably greater than 100 A. Capacities of 250 A or 400 A may be encountered in practice of the present invention.

It is known, for example, from Brazilian Patent Number P19706273, to provide for the electrical connection of a plurality of cables, for example, branch or tap cables, to a single feeder cable, using a busbar mounted in an insulating housing. In this patent, an array of metal support plates is slidably mounted, under the reaction of return springs, within a plastics housing. The support plates are apertured, and can be raised against the action of the springs by a screwdriver such that the apertures are aligned with respective inlet apertures of the housing so that conductors of the cables can be passed thereinto and secured in place in contact with a common busbar retained within the housing.

BRIEF SUMMARY OF INVENTION

In accordance with one aspect of the present invention, there is provided a switchable electrical interconnection arrangement comprising:

a busbar of greater than 30 A current capacity mounted in an electrically insulating housing;

means for electrically connecting a feeder cable to the busbar within the housing;

at least one connecting means mounted in the housing for making electrical connection to a respective branch cable that is receivable within the housing; and a switching arrangement mounted within the housing for selectively making electrical connection between the or each branch cable and the busbar, the switching arrangement comprising a switch moveable between an ON and an OFF position whereby a cam is rotatably driven so as to make and break electrical contact between an associated branch cable and the busbar.

In accordance with another aspect of the present invention, there is provided Switchable electrical interconnection arrangement of greater than 30 A current capacity comprising:

an electrically insulating housing having a first electrical conductor secured therein and an apertured chamber for receiving a second ("branch") electrical conductor;

wherein the chamber contains:

(a) a resiliently-biased support plate having an aperture that is alignable with the chamber aperture for receiving the second electrical conductor;

(b) an electrically-insulating cable holder having first and second interconnecting channels therein for receiving said first and second electrical conductors respectively, and being arranged to receive the support plate slidably mounted therewithin: and (c) a switching member that is movable between ON and OFF positions in which electrical contact is made and broken respectively between the first and second electrical conductors;

wherein the support plate is movable by an external force from a first position, against its resilient biasing, so as to slide within the cable holder to a stop position therewith such that further movement causes both the support plate and the cable support to move within the insulating housing thereby substantially to bring into alignment the apertures of the support plate and the housing to permit introduction of the second electrical conductor into the second channel of the cable holder within the housing;

wherein removal of the external force allows the support plate to move back to a second position, under the action of the resilient biasing, thereby to retain the second conductor within the second channel of the cable support; and wherein the switching member is movable between its OFF position in which the cable holder is retained spaced apart from the first electrical conductor, and its ON position in which the support plate and the cable holder are moved, under the restoring force of the resilient biasing, to a third position in which the second channel of the cable holder encompasses the second electrical conductor, thereby effecting electrical connection between the first and second electrical conductors The arrangement is preferably such as to exert a gripping or clamping force on the branch cable conductor of at least 10 Kgf, preferably 15 to 40 Kgf.

Thus, the electrical interconnection arrangement of the present invention is switchable such that even with the second conductor mechanically secured within the housing, electrical connection with the first conductor can be controlled by the switching member.

Although the switchable electrical interconnection arrangement of the present invention finds application to connect a single insertable second conductor with the retained first conductor of the housing, it finds especial application when the housing has a plurality of associated support plates, cable holders and switching members, whereby one, two or more second electrical conductors may be selectively brought into electrical connection with the first electrical conductor, in the form of an elongate busbar.

Advantageously, a camming arrangement interconnects the or each switching member with its associated cable holder, and these components may be mounted on a common support shaft. Rotation of the cammed switching member can then be arranged to produce reversible sliding movement of the cable holder to make and break electrical connection between the first and second electrical conductors.

In a preferred embodiment, the housing is provided with a pair of busbars to enhance the electrical connection with the one or more second electrical conductors.

Thus, in accordance with the present invention, branch or tap cables, i.e. the second conductors, may be introduced or removed selectively from the arrangement, without interference with any of the other second conductors, and this can be done whilst electrical connection to the first electrical conductor is interrupted for the selected tap cable whilst maintaining electrical connection to other branch cables.

The insulating housing may be made of a plastics or polymeric material. The housing may be constructed so as to have a total of ten cable ports for each electrical phase. One of the ports may be arranged to receive a feeder cable, whilst the remaining nine ports may be used for branching tap cables. Another option is to include two separately insulated electrical phases in the same arrangement, in which two ports will receive different feeder cables while the eight remaining ports will be divided into two groups of four to provide for up to four branching tap cables for each of the feeder cables.

The switching ability of the present electrical interconnection arrangement thus facilitates the selective connection and disconnection of tap cables without removing them physically.

A switchable electrical interconnection arrangement in accordance with the present invention, will now be described, by way of example, with reference to the accompanying drawings in which:

BRIEF DESCRIPTION OF THE DRAWINGS

FIG. 1 shows a ten port switchable busbar interconnection arrangement 2 that has an insulating polymeric housing 4 that is arranged to receive a single feeder cable (not shown) at an end port 6, and that has provision for receiving up to nine branching tap cables (not shown) in respective ones of identical tap ports 8, which are electrically insulated from each other.

DETAILED DESCRIPTION

Figure 1:
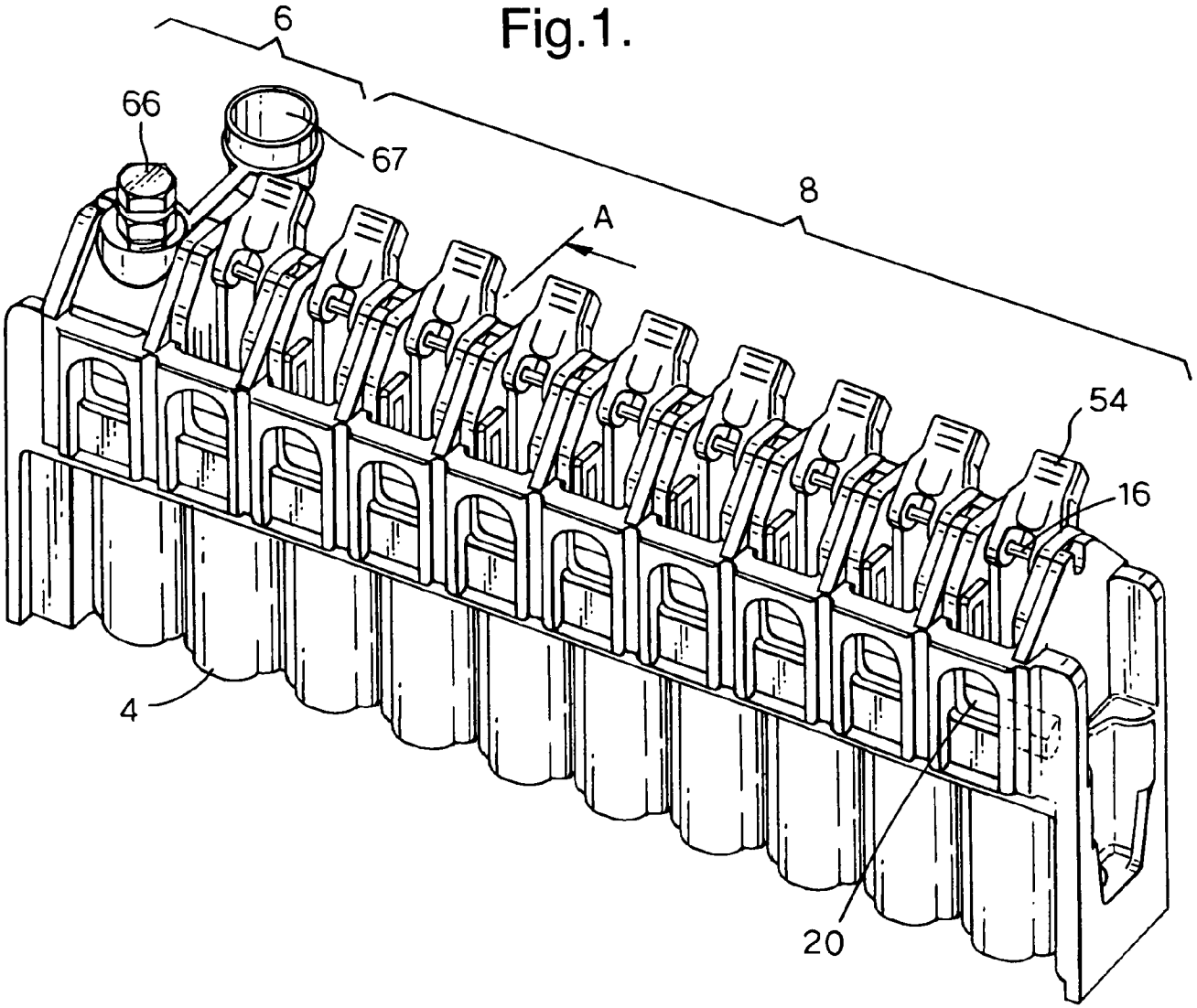
FIG. 1 is a perspective view of a switchable busbar arrangement.
Figure 2A:
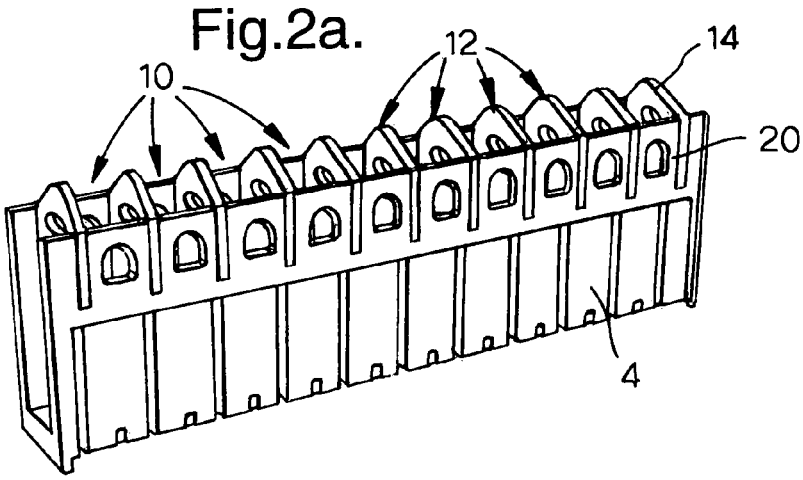
FIGS. 2*a*-2*f* are exploded views showing components of the arrangement of FIG. 1.

Referring to FIGS. 1 and 2*a*, the housing 4 is of a substantially rectangular configuration that is divided into ten cable-receiving chambers 10 with dividing walls 12 projecting therefrom. The walls 12 have longitudinally-aligned apertures 14 through which an upper support shaft 16 passes for mounting components of the arrangement as hereinafter described.

Figure 2B:
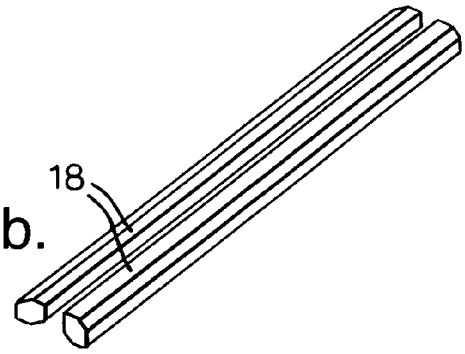
Figure 7:
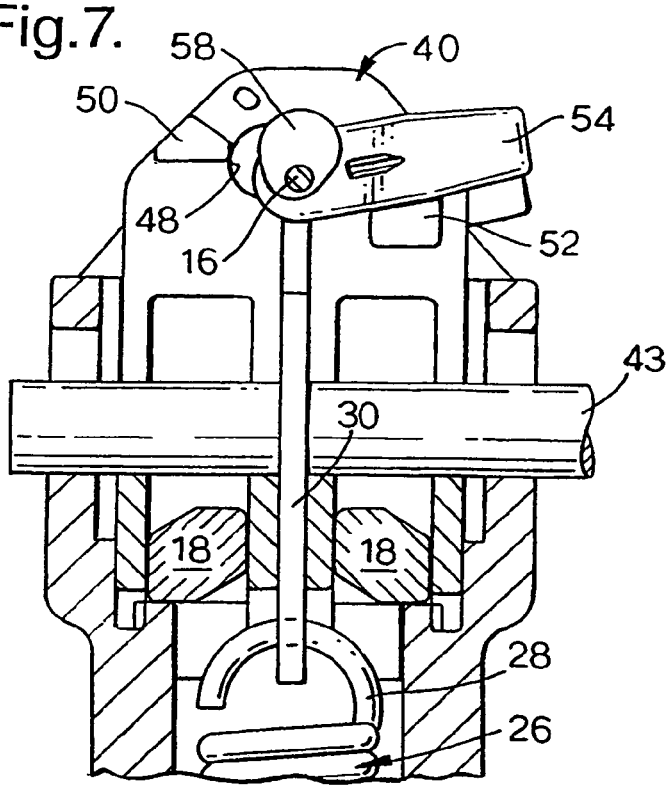
FIG. 7 is a section along the line A-A of FIG. 1, showing one of the connection ports in the OFF position.
Figure 8:
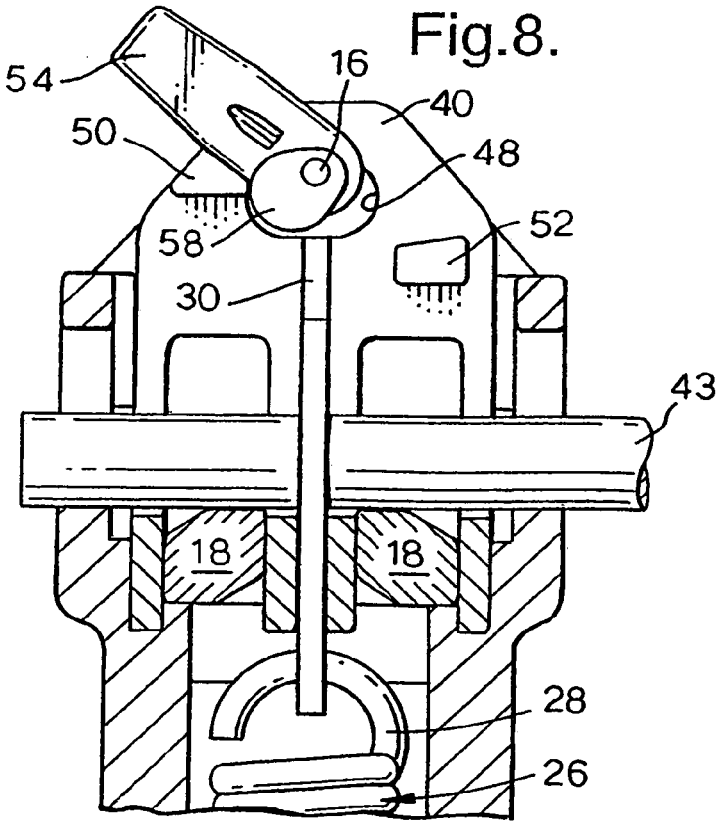
FIG. 8 is a view corresponding to that of FIG. 7 in the ON position.

Two conductive, copper, bars 18 (FIG. 2*b*) are secured longitudinally within the plastic housing 4 and extend through each of the chambers 10, as can be seen in FIGS. 7 and 8. The bars 18 comprise the busbars of the arrangement 2.

As can be seen from FIGS. 1 and 2*a*, each chamber 10 of the housing 4 has an aperture 20 in the side wall thereof for receiving the stripped end of an electrical cable.

Since each of the tap ports 8 and associated chambers 10 separated by a pair of dividing walls 12 are identical, the following description will be made in respect of a single set of these components.

Figure 2C:
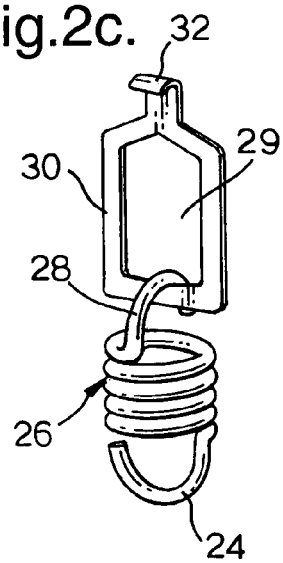
Figure 2D:
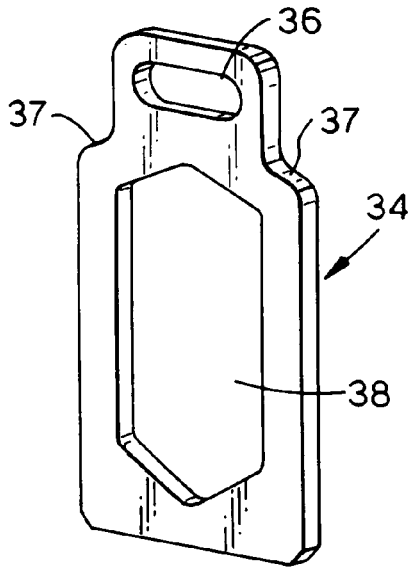
Figure 3:
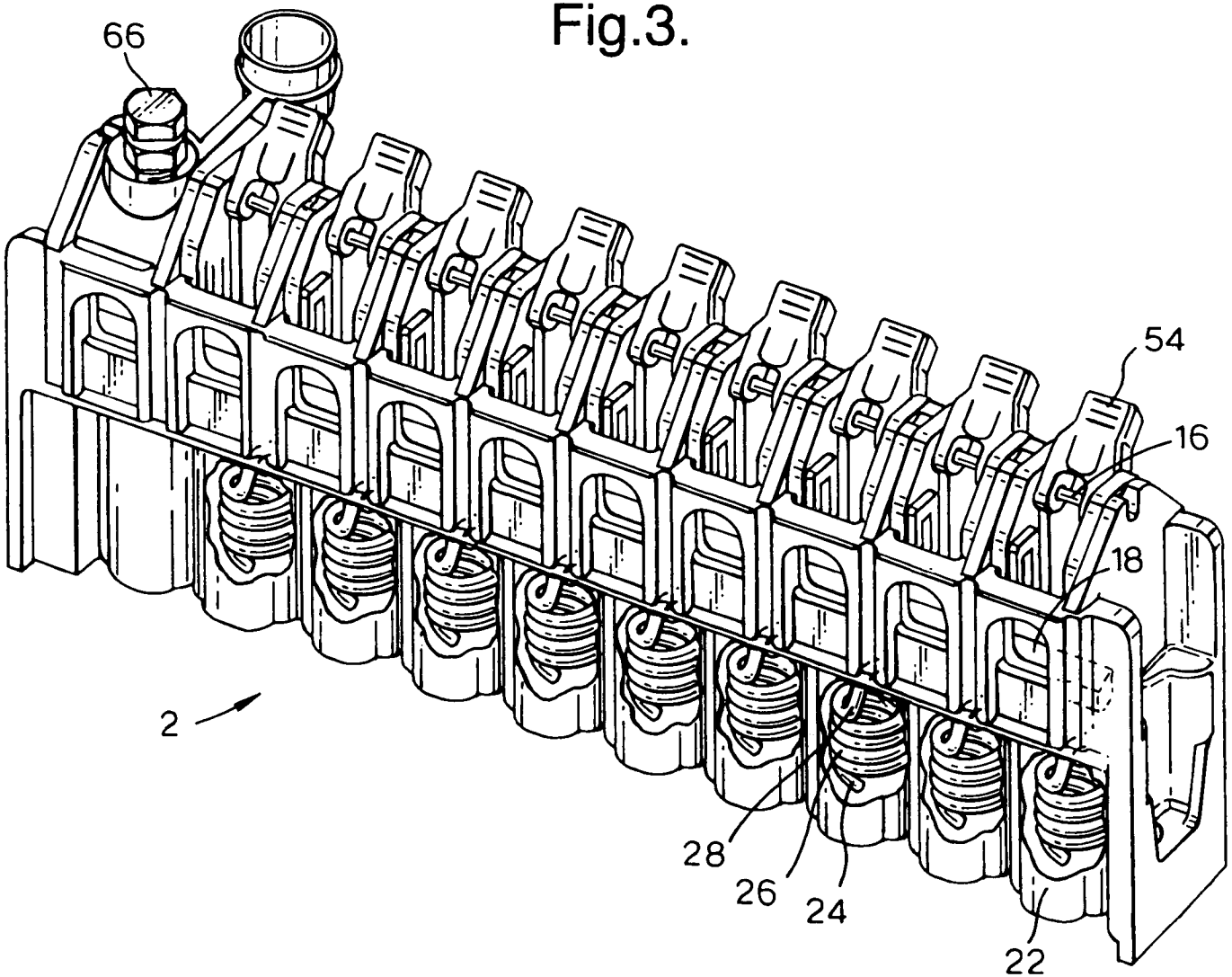
FIG. 3 is a partial cut away view of the arrangement of FIG. 1.

Referring to FIGS. 3 and 2*c*, a short shaft 22, extending transversely to the conductive bars 18, is located in the housing 4 at the lower end of the chamber 10, and serves to retain the lower end 24 of a tension spring 26, whose upper end 28 engages the aperture 29 of a support plate 30, the plane of which lies substantially parallel to the aperture 20 of the chamber 10. Although as shown in FIG. 2*c*, the upper end of the support plate 20 is bent over to form a hook 32, a preferred embodiment of the support plate is shown at 34 in FIG. 2*d*, which instead has an aperture 36 at its upper end beyond a pair of shoulders 37, beyond its aperture 38.

Figure 2E:
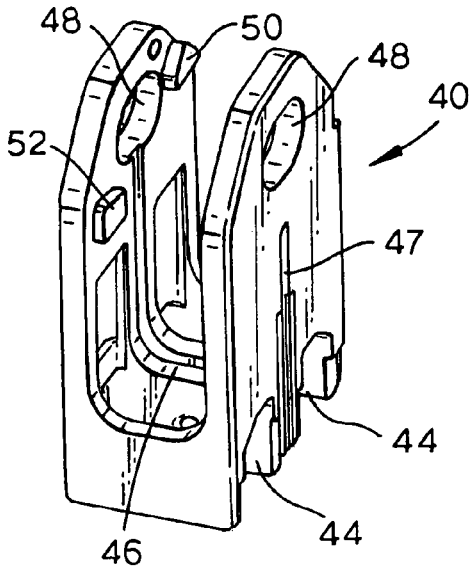

A cable holder 40, shown in detail in FIG. 2*e*, is slidably mounted within the chamber 10 and has a generally U-shaped upper channel 42 that can be aligned with the support plate aperture 38 and the housing aperture 20 for receipt of an electric cable 43 transversely therein (see FIGS. 7 and 8). The cable holder 40 also has a pair of downwardly-extending lower channels 44 for receiving respective ones of the busbars 18 of the arrangement 2 (see FIGS. 7 and 8). A dividing wall 46 that extends longitudinally of the housing 4, is slotted at 47 to receive the support plate 34 slidably therewithin. The upwardly-extending side walls of the cable holder 40 have respective oval apertures 48, by means of which the cable holder 40 is mounted on the longitudinally-extending upper shaft 16 of the housing 2 as hereinafter described. The facing inner surfaces of the cable holder 40 adjacent the apertures 48 are each provided with a pair of stops 50, 52 for the purpose discussed below.

Figure 2F:
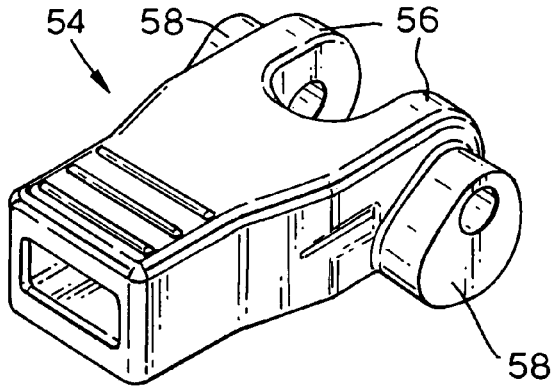

The final component within each chamber 10 of the arrangement 2 is a switching member 54 (shown in detail in FIG. 2*f*) that has a pair of spaced apart limbs 56 at one end that are apertured so as rotatably to mount the member 54 on the upper housing shaft 16. A cam 58 extends outwardly from each of the limbs 56 for engagement within the apertures 48 of the cable holder 40.

Figure 2G:
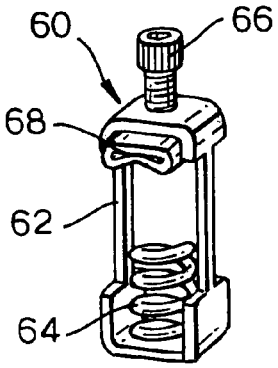

As mentioned above with reference to FIG. 1, the left hand port 6 of the arrangement 2 is for receipt of a feeder cable, and as such the contents of its chamber 10 differ from that of the chambers 10 of the tap ports 8. A feeder cable connection device 60, shown in detail in FIG. 2*g* comprises a metal body 62 that contains a compression spring 64 at its lower end. A shear head screw 66 is threadedly engaged at the upper end of the device 60 and is connected to an inner pressure plate 68. With the connection device 60 retained within the insulating housing 4, a feeder cable can be introduced through the feeder port aperture 20, so as to extend through the body 62, wherein it is tightened by means of the screw 66 and pressure plate 68 against the spring 64. After the connection is made, the screw 66 may be covered by a protective insulating cap 67. The device 60 is located transversely in the housing 4 between the busbars 18, and this tightening action not only secures the feeder cable within the device 60, but also ensures good electrical contact, against the returning action of the spring 64, of the feeder cable onto the pair of spaced apart busbars 18.

Figure 2H:
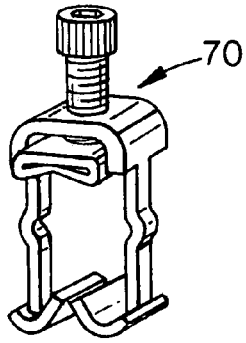

FIG. 2*h* shows a modification of the feeder cable connection device 60, wherein the resilience for retaining the cable is provided by flexibility of the body of the device 70.

In operation of the switchable electrical interconnection arrangement, a feeder electric cable is stripped of its insulation at one end, and the bare conductor is inserted into the aperture 20 of the port 6 so as to pass through the body 62 of the connecting device 60. The screw 66 is tightened up to its shear point, thereby ensuring good electrical connection between the feeder cable and the pair of busbars 18.

Figure 6:
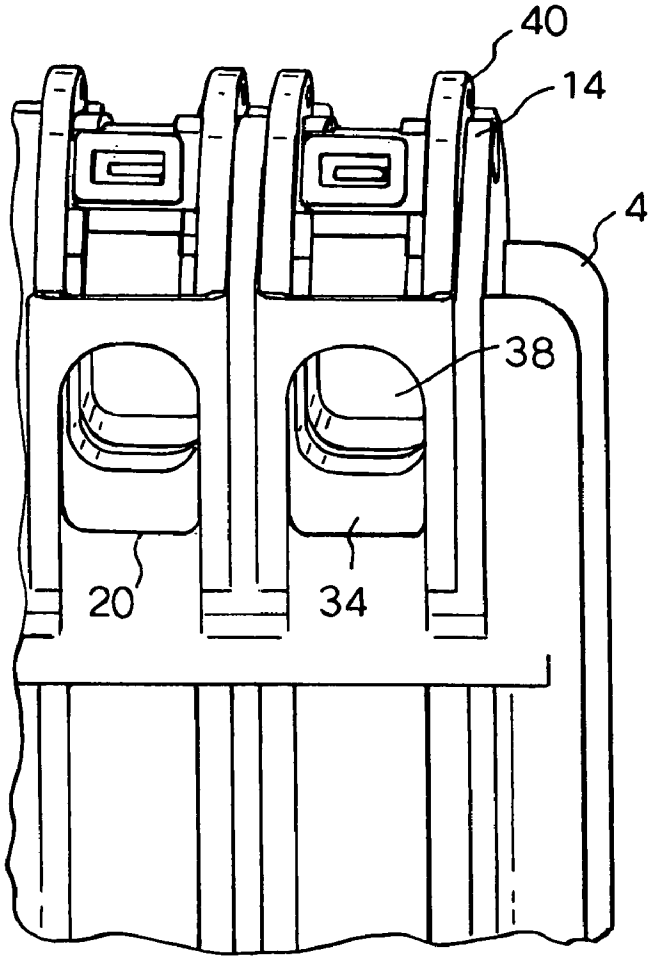
FIG. 6 is a front view of the arrangement of FIG. 4 in an OFF position.
Figure 4:
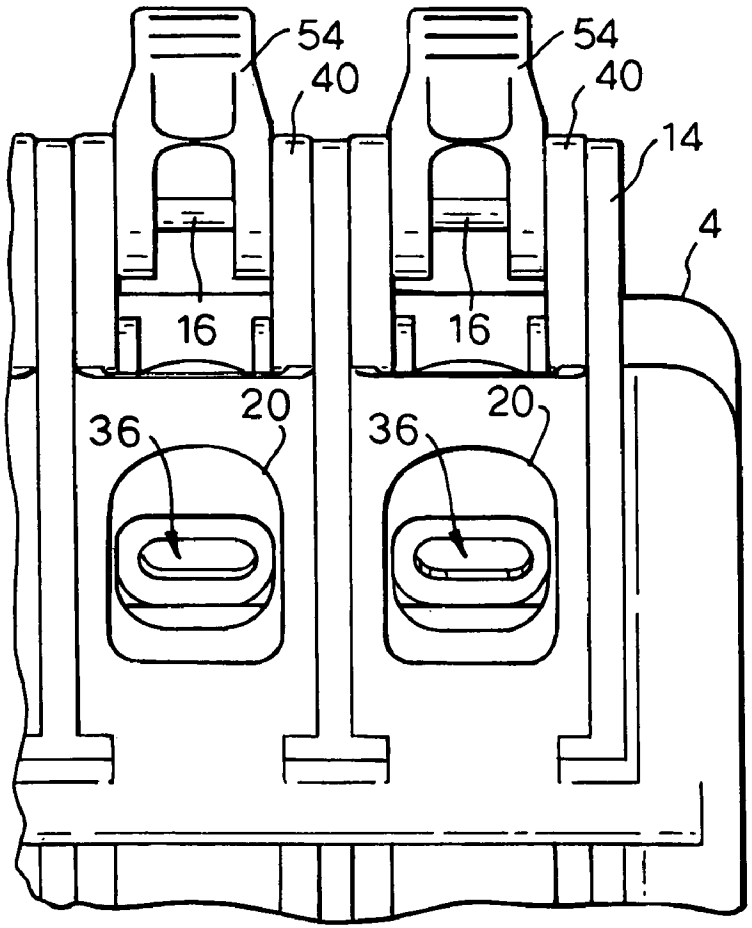
FIG. 4 is a front view of part of the arrangement of FIG. 1 in the ON position.
Figure 5:
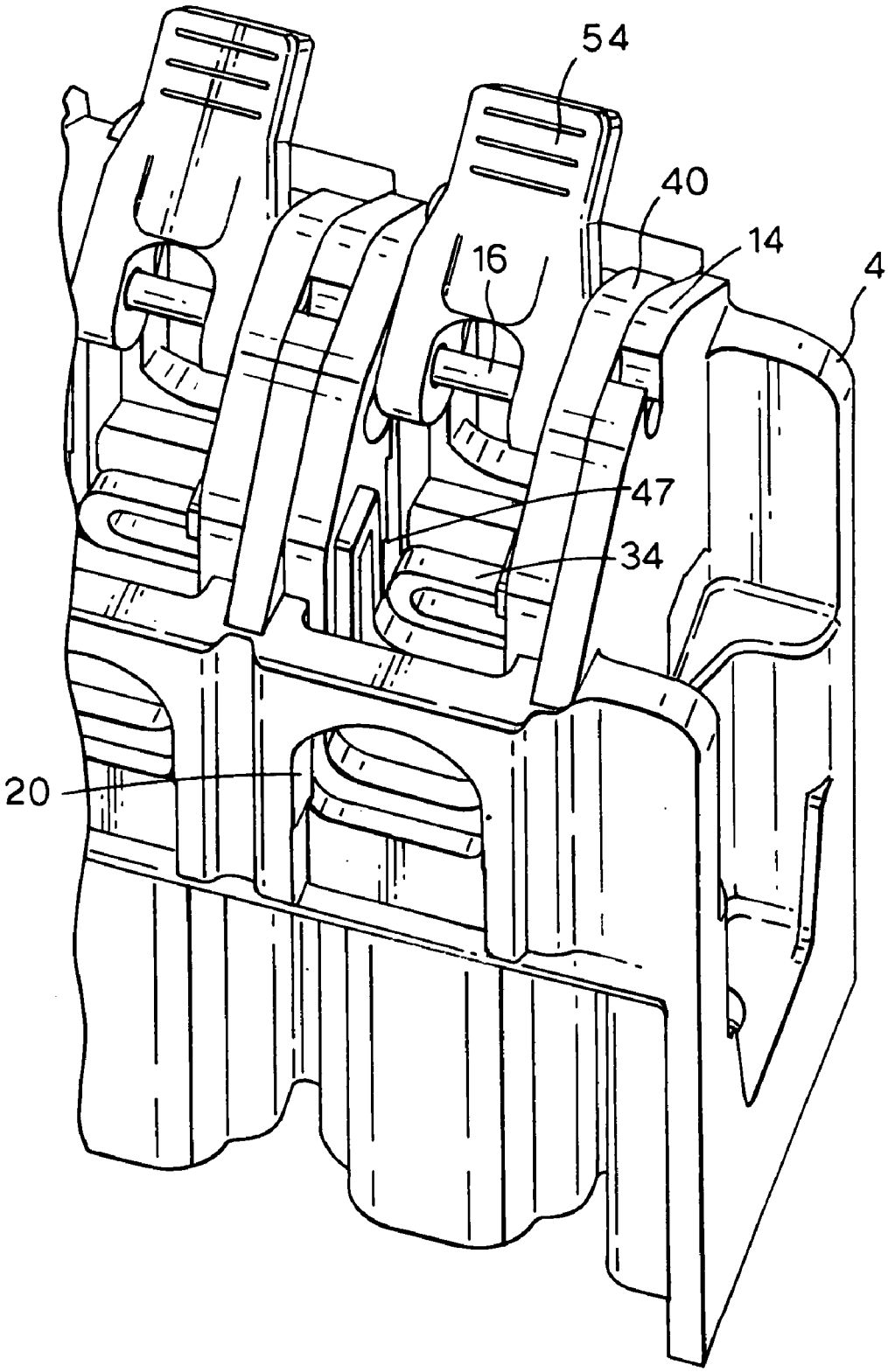
FIG. 5 is a perspective view corresponding to FIG. 4.

Whilst a branching tap cable may be connected into its aperture 20 of the tap port 8 with its switching member 54 in the ON or OFF position, connection is preferred, for safety reasons, to be made with it in the OFF position, abutting the stops 52 of the cable holder 40. In this position, as shown in FIGS. 6 and 7, the cams 58 of the switching member 54, which extend into the apertures 48 of the cable holder 40, have raised the cable holder 40 such that the upper shoulders thereof project above the upper surfaces of the projections 12, and the branch cable channel 42 is in a raised position. The support plate 34 may then be raised, by means of its aperture 36, for example by levering a screwdriver over the top of the housing 4 above the aperture 20, against the resistance of the spring 26, so as to dispose the support plate aperture 38 in alignment with the housing aperture 20 and with the channel 46. In this position, the stripped end of a tap cable conductor 43 can be inserted so as to lie along the channel 46 of the cable holder 40. Release of the screwdriver then allows the support plate 34 to return downwards under the action of the spring 26 until the tap conductor 43 in the channel 42 is urged against the cable holder dividing wall 46 (see FIG. 7). Thus, in this position the tap cable is mechanically securely retained within the housing 4 and is electrically separated from the busbars 18.

In order to make electrical connection between the branch cable and the busbars 18, and thus with the feeder cable, the switching member 54 is moved over from the OFF position shown in FIG. 7, to the ON position shown in FIG. 8, abutting the stops 50 of the cable holder 40. Owing to the eccentric mounting of the cams 58 within the oval apertures 48 of the cable holder 40, this movement allows the support plate spring 26 to pull both the support plate 34 and the cable holder 40 downwardly in the tap chamber 10, and to bring the branch cable 43 lying in the channel 42 of the cable holder 40 down into contact with the pair of busbars 18, which are now sitting within the channels 44 and straddled by the cable holder 40. It will be appreciated, that the upper surface of the dividing wall 46 of the cable holder 40 lies below the bottom of the channels 44 thereof, to allow this interengagement, which is enhanced by the return force of the support plate spring 26, which is still under tension.

It will be appreciated that by reversing the movement of the switching member 54, the cable holder 40, owing to the movement of the cams 58 within the holder apertures 48, is again pulled upwards in the chamber 10 until the switching member 54 again abuts the OFF stop 52.

It will also be appreciated, that each of the nine tap ports 8 may be operated independently of each other, so that appropriate ones of the branch cables 43 may be introduced or removed, and connected or disconnected, independently of the others.

Figure 9:
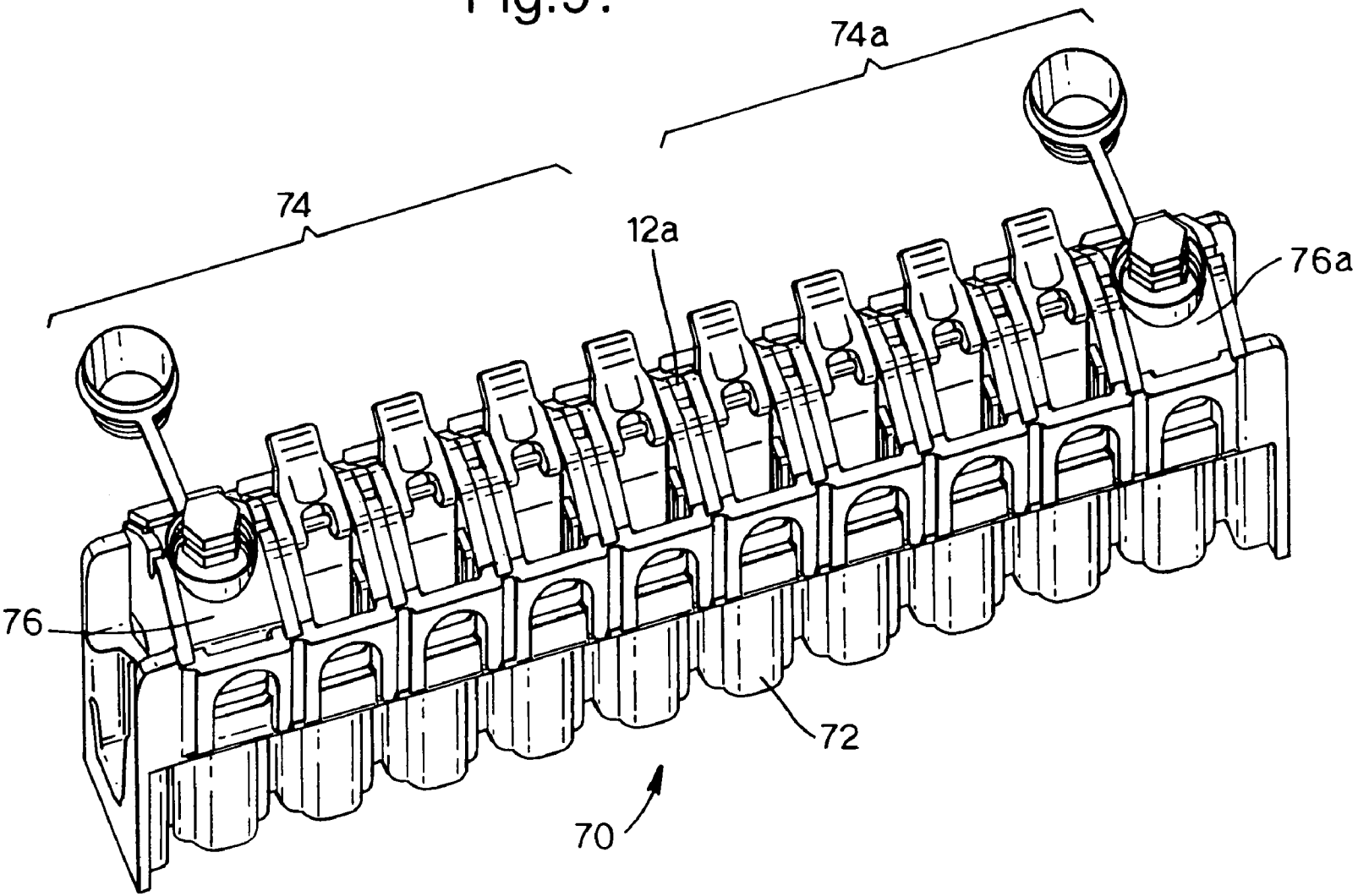
FIG. 9 is a perspective view of a modified switchable busbar arrangement.

FIG. 9 shows a modified switching arrangement 70, in which ten chambers of the housing 72 are divided into two groups 74, 74*a* of five chambers each. Each group 74, 74*a* can receive one feeder cable, for example of different phases, in a respective end port 76, 76*a* and can accommodate up to four branch cables in the remaining ports. The ports and other components of the arrangement 70 may be substantially as described above for the feeder and branch ports respectively of the arrangement 2. It will be appreciated that the busbars of the arrangement 70 will be approximately half the length of the busbars 18 of the arrangement 2, since they will be serving respective groups 74, 74*a* of the housing chambers, and will be insulated from each other.

It will be appreciated that fewer or more than eight branch ports may be provided by the switchable electrical interconnection arrangement of the invention.

The invention claimed is:

1. A switchable electrical interconnection of greater than 30 A current capacity comprising:

an electrically insulating housing having a first electrical conductor secured therein and an apertured chamber for receiving a second electrical conductor;

wherein the chamber contains:

(a) a resiliently-biased support plate having an aperture that is alignable with the chamber aperture for receiving the second electrical conductor;

(b) an electrically-insulating cable holder having first and second interconnecting channels therein for receiving said first and second electrical conductors respectively, and being arranged to receive the support plate slidably mounted therewithin: and (c) a switching member that is movable between ON and OFF positions in which electrical contact is made and broken respectively between the first and second electrical conductors;

wherein the support plate is movable by an external force from a first position, against its resilient biasing, so as to slide within the cable holder to a stop position therewith such that further movement causes both the support plate and the cable support to move within the insulating housing thereby substantially to bring into alignment the apertures of the support plate and the housing to permit introduction of the second electrical conductor into the second channel of the cable holder within the housing;

wherein removal of the external force allows the support plate to move back to a second position, under the action of the resilient biasing, thereby to retain the second conductor within the second channel of the cable support; and wherein the switching member is movable between its OFF position in which the cable holder is retained spaced apart from the first electrical conductor, and its ON position in which the support plate and the cable holder are moved, under the restoring force of the resilient biasing, to a third position in which the second channel of the cable holder encompasses the second electrical conductor, thereby effecting electrical connection between the first and second electrical conductors.

2. The switchable electrical interconnection according to claim 1, wherein the cable holder and the switching member (a) are mounted on a common support shaft, about which the switching member is rotatable, and (b) interengage with one another by a cam arrangement, thereby to make and break electrical contact between the first and second electrical conductors.

3. The switchable electrical interconnection according to claim 2, wherein the cam arrangement comprises a cam that is mounted externally on the switching member and that engages within an aperture of the cable holder.

4. The switchable electrical interconnection according to claim 1, comprising a plurality of said chambers.

5. The switchable electrical interconnection according to claim 1, comprising a plurality of first electrical conductors and wherein each cable holder comprises a corresponding plurality of second channels.

6. The switchable electrical interconnection according to claim 1, comprising means for connecting an electrical power supply cable to the or each first electrical conductor.

7. The switchable electrical interconnection according to claim 1, wherein the or each first electrical conductor comprises an elongate busbar.

* * * * *

UNITED STATES PATENT AND TRADEMARK OFFICE

CERTIFICATE OF CORRECTION

PATENT NO. : 7,371,979 B2
APPLICATION NO. : 10/578799
DATED : May 13, 2008
INVENTOR(S) : Vagner Fuzetti et al.

It is certified that error appears in the above-identified patent and that said Letters Patent is hereby corrected as shown below:

Title Page

Item 22, please delete "August 1, 2003" and insert -- October 27, 2004 --.

Item 86, please delete "PCT/RU03/00343" and insert -- PCT/6B04/04525 --.

Item 86, under 371 date, please delete "October 18, 2006" and insert -- May 5, 2006 --.

Signed and Sealed this

Second Day of September, 2008

JON W. DUDAS
*Director of the United States Patent and Trademark Office*